US007891305B2

(12) United States Patent
Newbould et al.

(10) Patent No.: US 7,891,305 B2
(45) Date of Patent: Feb. 22, 2011

(54) WALL MOUNTABLE SHELVING SYSTEM WITH RECTANGULAR FRAME AND REMOVABLE TRAYS

(75) Inventors: Peter J. Newbould, Milan (IT); Pasquale Cirulli, Milan (IT)

(73) Assignee: 3M Innovative Properties Company, St. Paul, MN (US)

( * ) Notice: Subject to any disclaimer, the term of this patent is extended or adjusted under 35 U.S.C. 154(b) by 482 days.

(21) Appl. No.: 11/849,390

(22) Filed: Sep. 4, 2007

(65) Prior Publication Data

US 2008/0053345 A1 Mar. 6, 2008

Related U.S. Application Data

(60) Provisional application No. 60/842,621, filed on Sep. 6, 2006.

(51) Int. Cl.
*A47B 23/00* (2006.01)

(52) U.S. Cl. ..... 108/42; 108/152; 211/90.04

(58) Field of Classification Search ..... 108/42, 108/47, 152; 248/214, 235; 211/89.01, 113, 211/119, 90.01, 90.03, 90.04
See application file for complete search history.

(56) References Cited

U.S. PATENT DOCUMENTS 2,665,182 A * 1/1954 Stanitz ..... 108/42
2,720,436 A * 10/1955 Covey ..... 108/47
3,598,064 A * 8/1971 Stempel ..... 108/42
3,799,072 A * 3/1974 Slaboden ..... 108/149
3,900,110 A * 8/1975 Soroka ..... 211/113
4,024,312 A 5/1977 Korpman
4,108,314 A 8/1978 Racca
4,850,282 A * 7/1989 Postic ..... 108/47
4,870,907 A * 10/1989 McKee ..... 108/42
4,969,580 A 11/1990 Mikhail
5,180,067 A * 1/1993 Conaway et al. ..... 211/119
5,255,401 A * 10/1993 Sambrookes et al. ..... 211/112
5,289,927 A 3/1994 Emery
5,433,152 A * 7/1995 Henry ..... 108/42
5,460,279 A 10/1995 Emery et al.
5,516,581 A 5/1996 Kreckel et al.
6,105,509 A * 8/2000 Altfeder ..... 108/42
6,231,962 B1 5/2001 Bries et al.
6,412,647 B1 7/2002 Ko
6,478,353 B1 * 11/2002 Barrozo ..... 211/113
6,520,351 B1 * 2/2003 Zadro ..... 211/119
6,541,089 B1 4/2003 Hamerski et al.
6,569,521 B1 5/2003 Sheridan et al.
6,641,910 B1 11/2003 Bries et al.
6,666,344 B1 12/2003 Schneider (Continued)

FOREIGN PATENT DOCUMENTS

DE 33 31 016 C2 6/1992

*Primary Examiner*—José V Chen
(74) *Attorney, Agent, or Firm*—Kenneth B. Wood

(57) ABSTRACT

A wall mountable shelving system includes a pair of support members, a storage tray extending between the support members, and stretch releasing adhesive strips arranged to secure the shelving system to the wall. Each support member includes a back plate and a frame member connected with the back plate, and each frame member includes at least a first support portion connected with and arranged generally perpendicular to the back plate, an extension portion arranged generally perpendicular to and extending from the first support portion, and a second support portion extending from the end of the extension portion and arranged generally parallel to the first support portion.

10 Claims, 1 Drawing Sheet

U.S. PATENT DOCUMENTS 6,972,141 B1 12/2005 Bries et al.
7,078,093 B2 7/2006 Sheridan et al.
2004/0188369 A1* 9/2004 Yu ..... 211/119

* cited by examiner

WALL MOUNTABLE SHELVING SYSTEM WITH RECTANGULAR FRAME AND REMOVABLE TRAYS

CROSS REFERENCE TO RELATED APPLICATION

This application claims the benefit of U.S. Provisional Patent Application No. 60/842,621, filed Sep. 6, 2006, the disclosure of which is incorporated by reference herein in its entirety.

TECHNICAL FIELD

The present invention relates generally to storage articles and, more particularly, to a storage shelf assembly that can be adhesively mounted to, for example, the interior surface of a bath or shower enclosure to hold a variety of items commonly used in the bath or shower.

BACKGROUND

Shower and bath storage devices, often referred to as shower or bath caddies, are commonly used to hold and/or store items such as soap, shampoo, and other bath items in shower and bath enclosures. Because of the weight of the stored items, and because it is generally not practical to mount such items in shower or bath enclosures using mechanical fasteners, such as nails and screws, such devices are typically hung from the shower nozzle fixture. Such devices are known in the prior art. U.S. Pat. No. 4,969,580 (Mikhail Essatt), U.S. Pat. No. 4,108,314 (Racca), U.S. Pat. No. 5,255,401 (Sambrookes et al.), and U.S. Pat. No. 6,520,351 (Zadro), for example, disclose such devices. It is also known to mount such devices using suction cups as disclosed in, for example, U.S. Pat. No. 5,289,927 (Emery).

Such devices, however, suffer from certain drawbacks and shortcomings. Devices that hang from the shower nozzle fixture, for example, tend to be large and cumbersome, and because such devices must hang down from the shower nozzle fixture below the shower head so the items in the caddy can be accessed by a user, they are unstable and tend to swing sideways or slide off of the shower nozzle fixture. In addition, the mounting location is limited by the location of the shower nozzle fixture such that they cannot be moved, and, because they must be mounted immediately below the shower head, they tend to interfere with the use of the shower. Devices mounted with suction cups, on the other hand, have limited holding capacity and tend to lose their holding ability over time. As a result, devices mounted with suction cups frequently fail, thereby causing the device and its contents to fall off the wall.

The need therefore exists for a storage device that can be adhesively mounted to the wall surface of a shower or bath enclosure that is inexpensive, easy to install, and holds strongly enough to support items commonly stored in such devices.

SUMMARY

The invention overcomes the above-identified limitations in the field by providing a shelving system that can be adhesively mounted to, for example, the wall surface of a shower or bath enclosure that is inexpensive, easy to install, and holds strongly enough to support items commonly stored in such devices.

In one embodiment, the present invention provides a wall mountable shelving system including a pair of support members, each support member including a back plate and a frame member connected with the back plate, each frame member including at least a first support portion connected with and arranged generally perpendicular to the back plate, an extension portion arranged generally perpendicular to and extending from the first support portion, and a second support portion extending from the end of the extension portion and arranged generally parallel to the first support portion; a storage tray extending between the associated first support portions of the frame members; and stretch releasing adhesive strips arranged between the back plate and the wall for securing the shelving system to the wall.

BRIEF DESCRIPTION OF DRAWINGS

The present invention will be further described with reference to the accompanying drawings, in which.

DETAILED DESCRIPTION

Figure 1:
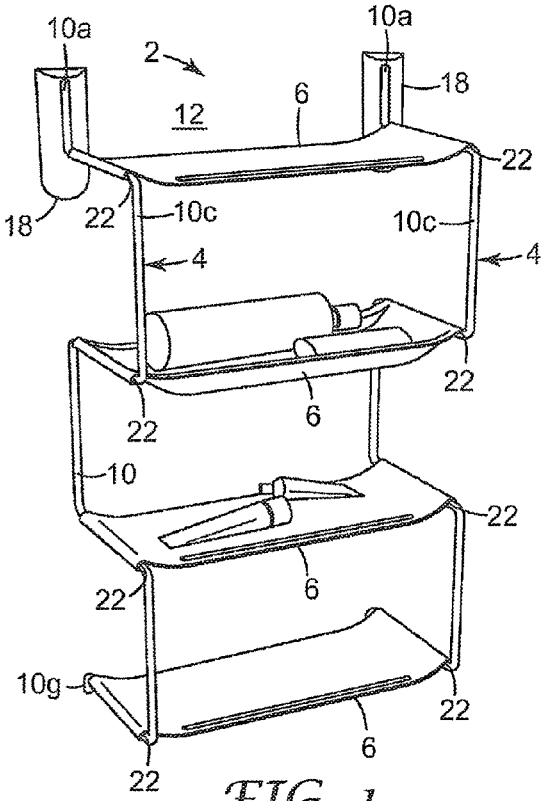
FIG. 1 is a perspective view of a wall mountable shelving system according to the invention.
Figure 2:
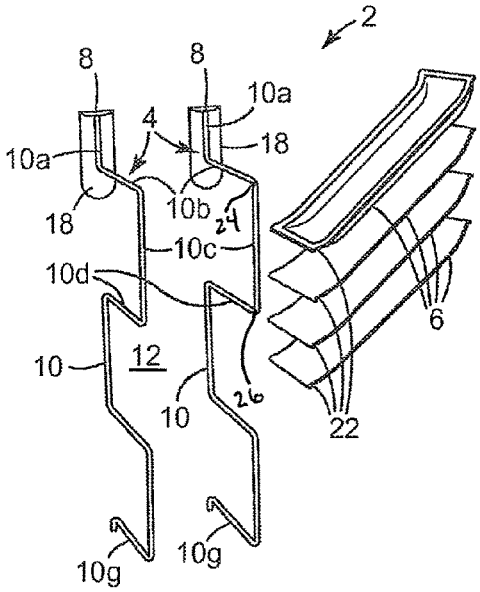
FIG. 2 is a perspective view of the shelving system shown with the storage strays removed.
Figure 3:
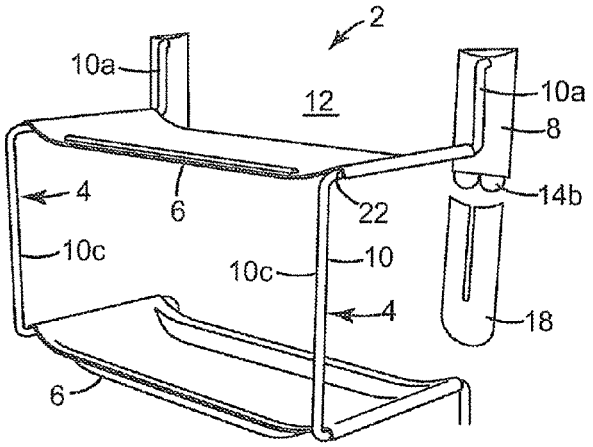
FIG. 3 is a partially exploded detailed perspective view showing the cover plate removed from the back plate.

Referring now to the drawings, wherein like reference numerals refer to like or corresponding parts throughout the several views, FIGS. 1-3, show a wall mountable shelving system 2 for storing items in, for example, a shower or bath enclosure. The shelving system 2 includes a pair of support members 4 and a plurality of removable storage trays 6 connected to, and arranged generally between, the support members 4.

Each support member 4 includes a back plate 8 (shown most clearly in FIG. 3) and a serpentine-like frame member 10 having a first end connected with a back plate 8. The serpentine-like frame member 10 extends generally downwardly from the back plate 8 along the wall surface 12. In the illustrated embodiment, each frame member 10 includes an optional terminal interface portion 10*a* , extending along and connected with the associated back plate 8, a first support portion 10*b* FIG. 2) extending outwardly from the terminal interface portion 10*a* in generally perpendicular relation to the back plate 8, an extension portion 10*c* arranged in generally perpendicular relation to, and extending downwardly from, the first support portion 10*b*, and a second support portion 10*d* (FIG. 2) extending inwardly toward the wall surface 12 from the end of the extension portion 10*c* in generally parallel relation to the first support portion 10*b*. In this manner, an elongated connection is formed between the back plate 8 and the frame member 10 that is stronger and more secure than if the first support portion 10 connected with the back plate 8 perpendicularly.

Stretch releasing adhesive strips 14 are arranged between the back plates 8 and the wall surface 12 for securing the shelving system 2 to the wall surface 12. A suitable stretch releasing adhesive is the double-sided stretch releasable adhesive strips available from 3, M Company, St. Paul, Minn. under the COMMAND trade designation. Commercially available COMMAND adhesive strips are currently manufactured as discrete strips with one end of the strip including a non-adhesive pull tab to facilitate stretching of the strip during removal.

In the illustrated embodiment, each side end of the storage trays 6 is curved to define a channel 22 that allows the storage trays 6 to be manually secured to, and removed from, the frame member support portions 10*b*, 10*d*. In addition, in the illustrated embodiment, the storage trays 6 are provided with a somewhat concave shape to allow them to better retain items placed therein. To allow water that collects in the storage trays to drain therefrom, the storage trays 6 may optionally contains openings (not shown). The storage trays 6 and back plates 8 may be formed of any suitable material such as, for example, metals and synthetic plastic materials or combinations thereof.

Stretch releasing adhesives are high performance pressure-sensitive adhesives that combine strong holding power with clean removal and no surface damage. The double-sided adhesive strips 14 may be any conventionally known stretch releasing adhesive tape including a stretch releasing adhesive tape with an elastic backing, a stretch releasing adhesive tape with a highly extensible and substantially inelastic backing, or a stretch releasing adhesive tape comprising a solid elastic pressure sensitive adhesive, but are preferably stretch releasable adhesive strips that are moisture resistant (i.e. they maintain their holding power in the presence of water and/or in high humidity environments).

Specific tapes suitable for use in the various embodiments of the present invention include the pressure sensitive adhesive tapes with elastic backings described in U.S. Pat. No. 4,024,312 (Korpman), the pressure sensitive adhesive tapes with highly extensible and substantially inelastic backings described in U.S. Pat. Nos. 5,516,581 (Kreckel et al.) and 6,231,962 (Bries et al.), 6,569,521 (Sheridan et al.), 7,078,093 (Sheridan et al.), and the solid elastic pressure sensitive adhesive described in German Patent No. 33 31 016. Other suitable stretch releasing adhesive constructions include the stretch removable adhesive tape laminate including a separable fastener described in U.S. Pat. No. 6,972,141 (Bries et al.), and the elongate stretch removable tape constructions described in U.S. Pat. Nos. 6,641,910 (Bries et al.), and 6,541,089 (Hamerski et al.)

In the illustrated embodiment, the lower most support portion 10*g* (FIG. 2) of each frame member 10 is dimensioned to abut the wall surface 12 when the shelving system 2 is mounted on the wall surface 12. Dimensioning the lower most support portion 16 in this manner provides the shelving system with rotational stability and also minimizes the peel force exerted on the adhesive strips 14 produced by the weight of the shelving system and the items supported thereon.

The stretch releasing adhesive strips 14 include an adhesive portion, which in the FIGS is concealed by the back plates 8, and a non-adhesive pull tab portion 14*b* that extends outwardly beyond the bottom the back plates 8 as shown most clearly in FIG. 3. If the adhesive strips 14 include a separable fastener, such as is described in U.S. Pat. No. 6,972,141 (Bries et al.), the back plate 8 can be designed to conceal both the adhesive portion and the non-adhesive pull tab portion 14*b* of the adhesive strip. This is because each adhesive strip can be removed by first separating the adhesive strip via the separable fastener and then stretch removing each remaining half from its respective surface.

As shown in the illustrated embodiment, if the adhesive strip 14 does not include a separable fastener, the shelving system 2 may include optional cover plates 18 that may be arranged in overlapping relation with each back plate 8. To allow the cover plates 18 to connect with the back plates 8, the cover plates 18 contain elongated slots that correspond to the frame member 10. When assembled to the back plates 8, the cover plates 18 overlay, and thereby serve to conceal, the non-adhesive pull tab portion 14*b* of the adhesive strips 14, but when the cover plates 18 are removed from the back plates 8, the non-adhesive pull tabs 14*b* are exposed and can be readily accessed by a user wishing to stretch remove the adhesive strips 14 from the wall surface 12.

The frame member 10 may be constructed from any suitable rigid material including metals or synthetic plastic materials. A particularly suitable material is a continuous metal rod such as a vinyl coated rod. Metals are desirable because of their strength and their fabrication characteristics. To allow the shelving system 2 to be transported or stored more compactly, the frame members 10 may include a hinged construction that allows the support portions 10*b*, 10*d* and the extension portion 10*c* to be folded together. For example, FIG. 2 identifies an optional hinged construction in the form of a first hinged connection 24 between the first support portion 10*b* and the extension portion 10*c*, and a second hinged connection 26 between the second support portion 10*d* and the extension portion 10*c*. The storage trays 6 may be formed of metal, synthetic plastic materials, or fabrics such as canvas or an open net-like material. In addition, the trays 6 may be designed for specific purposes depending on the intended end use application for the tray.

Persons of ordinary skill in the art may appreciate that various changes and modifications may be made to the invention described above without deviating from the inventive concept. For example, it will be recognized that the shelving system may be designed to include any number of storage trays. Thus, the scope of the present invention should not be limited to the structures described in this application, but only by the structures described by the language of the claims and the equivalents of those structures.

What is claimed is:

1. A wall mountable shelving system, comprising:

(a) a pair of support members each including a back plate and a frame member connected with the back plate, wherein each frame member includes at least:

a first support portion connected with and arranged generally perpendicular to the back plate, an extension portion arranged generally perpendicular to and extending from the first support portion, a second support portion extending from an end of the extension portion opposite the first support portion and arranged generally parallel to the first support portion;

(b) a storage tray extending between the associated first support portions of the frame members;

(c) stretch releasing strips each including an adhesive portion and a non-adhesive pull tab portion, respective ones of the stretch releasing strips arranged between a corresponding one of the back plates and a wall surface for securing the shelving system to the wall surface and including the non-adhesive pull tab portion extending outwardly beyond an end of the corresponding back plate; and (d) a pair of cover plates removably connected to the back plates, respectively, such that each cover plate and the corresponding back plate are configured to provide an assembled state and a removed state, and wherein:

the cover plates are sized and shaped such that in the assembled state, the cover plate is assembled to the corresponding back plate and the cover plate extends beyond the end of the corresponding back plate to overlay and conceal the non-adhesive pull tab portion of the corresponding stretch releasing adhesive strip, in the removed state, the cover plate is removed from the corresponding back plate and the non-adhesive pull tab portion of the corresponding stretch releasing strip is exposed beyond the end of the corresponding back plate.

2. A shelving system as defined in claim 1, wherein each of the cover plates forms an open-ended slot sized to slidably receive the corresponding frame member.

3. A shelving system as defined in claim 1, wherein each frame member includes a terminal interface portion connected with the associated back plate.

4. A shelving system as defined in claim 3, wherein each interface portion extends along and is connected with a major portion of the associated back plate.

5. A shelving system as defined in claim 4, wherein the first support member extends from the corresponding terminal interface portion to define a bend, and further wherein the bend is arranged against the corresponding back plate.

6. A shelving system as defined in claim 1, wherein the second support portion extends from the extension portion toward a plane of the corresponding back plate to abut the wall surface when the shelving system is mounted on the wall surface.

7. A shelving system as defined in claim 1, wherein the frame member is constructed from a continuous metal rod.

8. A shelving system as defined in claim 1, wherein each tray includes drainage openings.

9. A shelving system as defined in claim 1, wherein the support portions are hingeably connected with the extension portion.

10. A shelving system as defined in claim 1, wherein a central axis of the first support member intersects the corresponding back plate.

* * * * *

UNITED STATES PATENT AND TRADEMARK OFFICE

CERTIFICATE OF CORRECTION

PATENT NO. : 7,891,305 B2
APPLICATION NO. : 11/849390
DATED : February 22, 2011
INVENTOR(S) : Newbould et al.

It is certified that error appears in the above-identified patent and that said Letters Patent is hereby corrected as shown below:

Column 2
Line 44, delete "10a ," and insert -- 10a --, therefor.

Column 2
Line 46, delete "FIG. 2)" and insert -- (FIG. 2) --, therefor.

Column 2
Line 62, delete "3, M" and insert -- 3M --, therefor.

Signed and Sealed this
Twenty-second Day of November, 2011

David J. Kappos

David J. Kappos
*Director of the United States Patent and Trademark Office*